US006648237B2

(12) United States Patent
Rothkopf et al.

(10) Patent No.: US 6,648,237 B2
(45) Date of Patent: Nov. 18, 2003

(54) TOY VEHICLE TRACK SEGMENT AND METHOD OF MANUFACTURING A TOY VEHICLE TRACK SEGMENT

(75) Inventors: Richard Rothkopf, Chicago, IL (US); Donald E. Toht, Wheaton, IL (US); K. Dale Weathington, Mid-Levels (HK); Lin Ming Chuan Cindy, Kowloon (HK)

(73) Assignee: Learning Curve International, Inc., Chicago, IL (US)

( * ) Notice: Subject to any disclaimer, the term of this patent is extended or adjusted under 35 U.S.C. 154(b) by 11 days.

(21) Appl. No.: 10/054,074

(22) Filed: Nov. 13, 2001

(65) Prior Publication Data

US 2003/0089789 A1 May 15, 2003

(51) Int. Cl.[7] ..... A63H 19/00
(52) U.S. Cl. ..... 238/10; 238/10 B; 446/445
(58) Field of Search ..... 238/10 E, 10 F, 238/10 B, 30, 29, 10 R, 10 A, 10 C; 446/445, 444, 476; 428/151, 213; 404/19, 42; 105/1.5

(56) References Cited

U.S. PATENT DOCUMENTS

| | | | | | |
|---|---|---|---|---|---|
| 3,628,725 | A | * | 12/1971 | Edwards et al. | 235/29 R |
| 4,516,953 | A | | 5/1985 | Hippely et al. | |
| D280,919 | S | | 10/1985 | Petersson | |
| D287,608 | S | | 1/1987 | Petersson | |
| D287,609 | S | | 1/1987 | Petersson | |
| D303,693 | S | | 9/1989 | Petersson | |
| 4,941,610 | A | | 7/1990 | Frauca | |
| 5,160,091 | A | | 11/1992 | Hesse | |
| D344,306 | S | | 2/1994 | Ruszkai | |
| D344,307 | S | | 2/1994 | Ruszkai | |
| D344,308 | S | | 2/1994 | Ruszkai | |
| D344,309 | S | | 2/1994 | Ruszkai | |
| D344,310 | S | * | 2/1994 | Ruszkai | D21/143 |
| D344,555 | S | | 2/1994 | Ruszkai | |
| D344,992 | S | | 3/1994 | Ruszkai | |
| 5,297,484 | A | | 3/1994 | Piserchia et al. | |
| 5,454,513 | A | * | 10/1995 | Wilson | 238/10 E |
| D382,026 | S | | 8/1997 | Petersson | |
| D382,027 | S | | 8/1997 | Petersson | |
| 5,704,822 | A | | 1/1998 | Nilsson | |
| D406,363 | S | * | 3/1999 | Molnar | D25/156 |
| 6,155,177 | A | | 12/2000 | Backfisch | |
| 6,389,870 | B1 | * | 5/2002 | Vigil | 72/392 |

* cited by examiner

*Primary Examiner*—S. Joseph Morano
*Assistant Examiner*—Frantz F. Jules
(74) *Attorney, Agent, or Firm*—Wallenstein Wagner & Rockey, Ltd.

(57) ABSTRACT

A toy vehicle track segment is disclosed. The toy vehicle track segment has a first end, a second end, an upper surface, and a plurality of nodes. The upper surface has a pair of parallel recessed rails extending from the first end to the second end. Each rail has an inner wall joined to an outer wall by a base surface. The plurality of nodes are located within at least one of the pair of rails. The nodes are provided for improving traction of a toy vehicle as it traverses along the upper surface. The nodes are located on the base surface and extend along a first direction transverse to the length of the upper surface.

19 Claims, 6 Drawing Sheets

TOY VEHICLE TRACK SEGMENT AND METHOD OF MANUFACTURING A TOY VEHICLE TRACK SEGMENT

TECHNICAL FIELD

The present invention relates generally to toy vehicle tracks, and more particularly, the present invention relates to a realistic toy vehicle track segment having a means for providing improved traction.

BACKGROUND

In the toy vehicle industry, small toy trains are often run on wooden tracks. These railway systems are designed to grow with the child. In other words, railway configurations can range from very simple ovals to complex systems incorporating bridges, buildings, tunnels, and towns. Many other accessories are available as well such as: toy figurines, bushes, shrubs, and trees to lend the system a realistic effect; playmats, playboards, and play tables on which to build a railway system; carry bags and boxes in which to store the railway system when not in use; and, storybooks, iron-ons, decals, and coloring books to further stimulate the child's imagination.

The railway configurations are built from individual track sections. The track sections range in size and shape. There are countless possibilities for individual track sections: some are straight; some feature switching mechanisms; some are curved; and, some are ascending for connection to another track positioned at a higher level.

An important aspect of these railway systems is that the track sections be interchangeable. Accordingly, most track sections have a male connector at one end and a female connector at an opposing end. This allows the track sections to be connected end-to-end in a variety of configurations. Adding to the interchangeability of the track sections is the fact that these track sections are usually reversible.

Manufacturers increase the entertainment value of the toy railway systems by introducing interesting audio and/or visual stimuli. One example of this is disclosed in U.S. Pat. No. 5,454,513 (the '513 patent). The '513 patent discloses a toy track segment including a pair of parallel rails, each having a plurality of spaced discontinuities. The discontinuities are provided to produce rhythmic "clacking" sound as a toy vehicle traverses along the track segment.

The track segment of the '513 patent also includes a plurality of spaced ribs extending transverse to the parallel rails to simulate railroad ties. The ribs are generally slots cut into the surface of the track. The slots produce sharp angles on an upper surface of the track segment. The sharp angles may be susceptible to splintering, chipping, and/or cracking because the track segments are typically produced from wood. In addition, the manufacture of the ribs requires an additional milling step which is costly and creates additional sawdust that must be cleaned from the shop floor.

Recently, toy train manufacturers have provided battery powered toy vehicles, e.g. locomotives, for use with the wooden railway systems. The battery powered toy vehicles have enjoyed much commercial success. However, the toy vehicle's wheels often slip along the upper surface of the individual wooden track segments. This primarily occurs when the toy vehicle is pulling additional vehicles and/or when the toy vehicle is ascending an upwardly angled track segment.

SUMMARY OF THE INVENTION

One object of the present invention is to provide a toy vehicle track segment. The toy vehicle track segment comprises a first end, an opposing second end, and an upper surface. The upper surface includes a pair of parallel recessed rails. The rails extend over a length of the upper surface from the first end to the second end. Each rail has an inner wall joined to an outer wall by a base surface.

At least one of the rails includes a plurality of nodes. The nodes are located within the rails to provide increased traction as a toy vehicle traverses along the upper surface of the toy vehicle track. The plurality of nodes located on the base surface and extend along a first direction transverse to the length of the upper surface.

A further object of the present invention is to provide a toy vehicle track segment comprising a distal end, an opposing proximal end, and an upper surface. The upper surface joins the distal end and the proximal end. The upper surface comprises a pair of parallel recessed rails and a plurality of spaced railroad ties.

The rails extend over a length of the upper surface from the distal end to the proximal end. Each rail has an inner wall joined to an outer wall by a base surface.

The ties extend transverse to the rails. Each tie has a pair of substantially linear parallel debossed impressions with a plurality of curvilinear debossed impressions therebetween.

Yet another object of the present invention is to provide a method of producing a toy vehicle track segment. The method comprises the steps of providing a segment of a solid material, forming a pair of parallel members, and forming nodes within the parallel members. The segment of a solid material has an upper surface, a lower surface, opposing first and second edges, and opposing first and second ends. The pair of parallel members are recessed into the upper surface and extend in a direction from the first end to the second end. Each parallel member has a width and a length. The nodes are formed across the width of at least one of the parallel members.

Other objects, advantages, and aspects of the present invention will become apparent upon reading the following description of the drawings and detailed description of the invention.

DETAILED DESCRIPTION

Figures 1, 2, 3, 4:
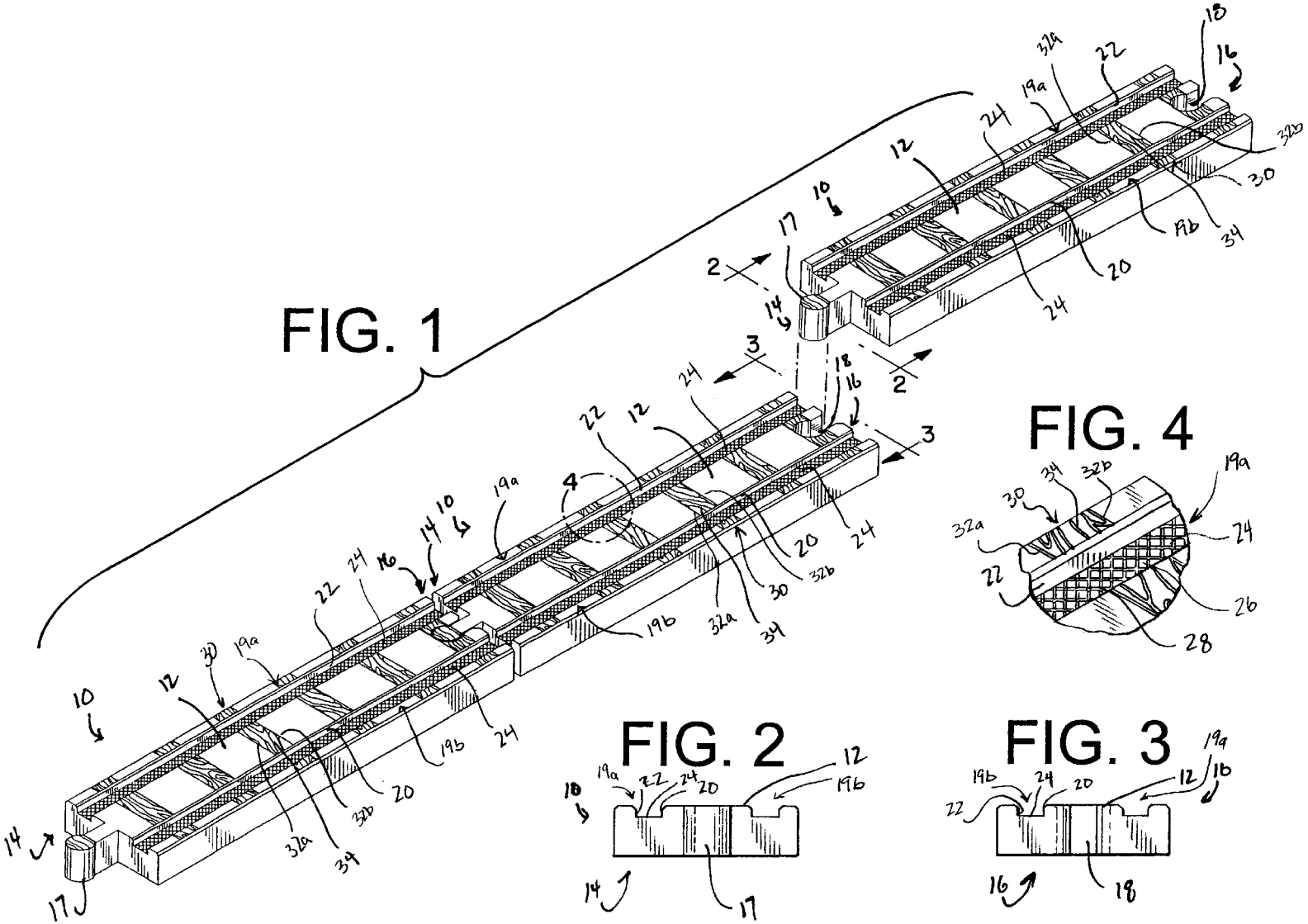
FIG. 1 is a perspective view of three interconnected toy vehicle track segments.
FIG. 2 ia a end view of a toy vehicle track segment.
FIG. 3 is a end view of a toy vehicle track segment.
FIG. 4 is a partial perspective view about the area designated "4" of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIGS. 1–4, a toy vehicle track segment 10 of the present invention is illustrated. The track segment 10 comprises an upper surface 12 which joins a first or distal end 14 with a second or proximal end 16. The ends 14, 16 include connectors 17, 18 for joining adjacent track segments.

The upper surface 12 includes a pair of rails 19*a* and 19*b*. The rails 19*a*, 19*b* are spaced inwardly from edge portions of the track segment 10 and extend parallel to each other from the first end 14 to the second end 16. Each rail 19*a*, 19*b* has inner and outer walls 20, 22 joined by a base surface 24 to form a substantially U-shaped, longitudinal recess.

The base surface 24 includes a continuous, uninterrupted pattern of nodes 26 extending along a length of each rail 19*a*, 19*b*. The nodes 26 provide a means by which traction is increased as a toy vehicle traverses the length of toy vehicle track segment 10. This is especially important when the toy vehicle is a battery powered vehicle because any slippage that occurs between the vehicle wheels and the track segment will prevent the vehicle from traversing the segment, especially upwardly angled segments and/or when the toy vehicle is pulling a load.

Generally, the pattern includes two or more nodes 26 across the width of the base surface 24 from the inner wall 20 to the outer wall 22 or transverse to the length of each rail 19*a*, 19*b*. The nodes 26 may be impressed (relief) or embossed (raised) members relative to the remaining portions of the base surface 24, preferably the maximum relief should not exceed 1 mm.

The nodes 26 are preferably formed by crisscrossing impressed linear divisions or narrow grooves 28 from the inner wall 20 to the outer wall 22. The divisions 28 are impressed into the base surface 24 at angles relative to the inner and outer walls 20, 22, some divisions 28 having an angle greater than 90 degrees and other divisions 28 having an angle less than 90 degrees to form an X-shaped pattern. The divisions 28 should not exceed 1.25 mm in depth, and more preferably are less than or equal to 0.1 mm; however, the division 28 depths can be any range or combination of ranges therein.

The angling of the divisions 28 forms diamond shaped nodes 26. The nodes 26 generally have a length of less than about 3 mm, but more preferably have a length of approximately 2 mm. It should be understood that the divisions 28 can be curvilinear, and that the nodes 26 can take any geometric shape and size without departing from the spirit invention.

The upper surface 12 also includes railroad ties 30. The railroad ties 30 are generally impressed or embossed members extending a width of the track segment 10 from one edge portion 31*a* to another 31*b*. The railroad ties 30 of the present invention are manufactured to simulate the wooded railroad ties of conventional railroad systems. Each tie 30 includes spaced linear parallel impressions 32*a*, 32*b*. Several curvilinear impressions 34 are located between the spaced impressions 32*a*, 32*b*. Preferably, the spaced impressions 32*a*, 32*b* are substantially linear and parallel rather than exactly linear and parallel. Substantially linear and parallel is meant to encompass spaced impressions 32*a*, 32*b* that are both linear and parallel and nearly linear and parallel; i.e., the spaced impressions 32*a*, 32*b* are manufactured to mimic the wooden railroad ties used in conventional railroads which seldom include exact linear or parallel edges. In other words, the spaced impressions 32*a*, 32*b* may include the deviations from linearity that an edge of a conventional railroad tie would exhibit.

The spaced impressions 32*a*, 32*b* and the curvilinear impressions 34 are provided with a pigment to set them apart visually from the surrounding portions of the upper surface 12. The pigment may be an ink, paint, burnishing, or burning of the upper surface 12. Alternatively, the pigment can be added to the area of the ties surrounding the impressions 32*a*, 32*b*, and 34 or can cover any or all portions of the tie 30.

In alternate embodiments, the track segment 10 can be supplied with a reversible lower surface. The lower surface may have an identical pair of rails and railroad configuration. Alternatively, the lower surface can be supplied with a road surface. The road surface includes a recessed road portion that is similar to one of the pair of rails except that the road surface is wider, taking up most of the lower surface. The road surface is then provided with road pattern consisting of a dashed line.

Figure 5:
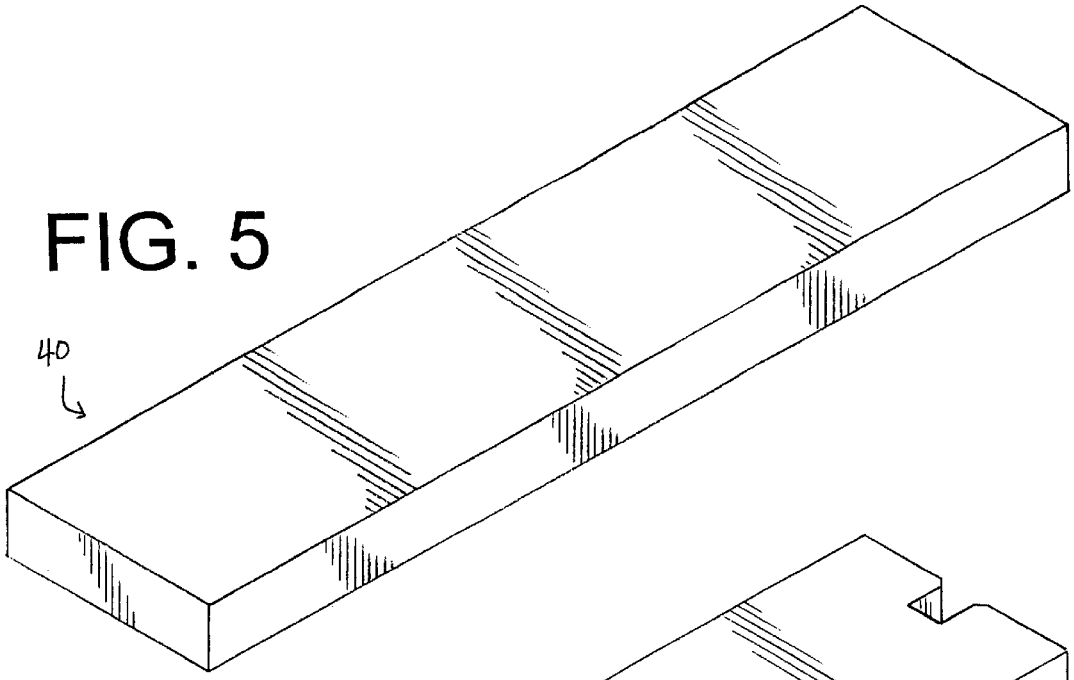
FIGS. 5–10 show the steps of manufacturing a toy vehicle track segment.
Figure 6:
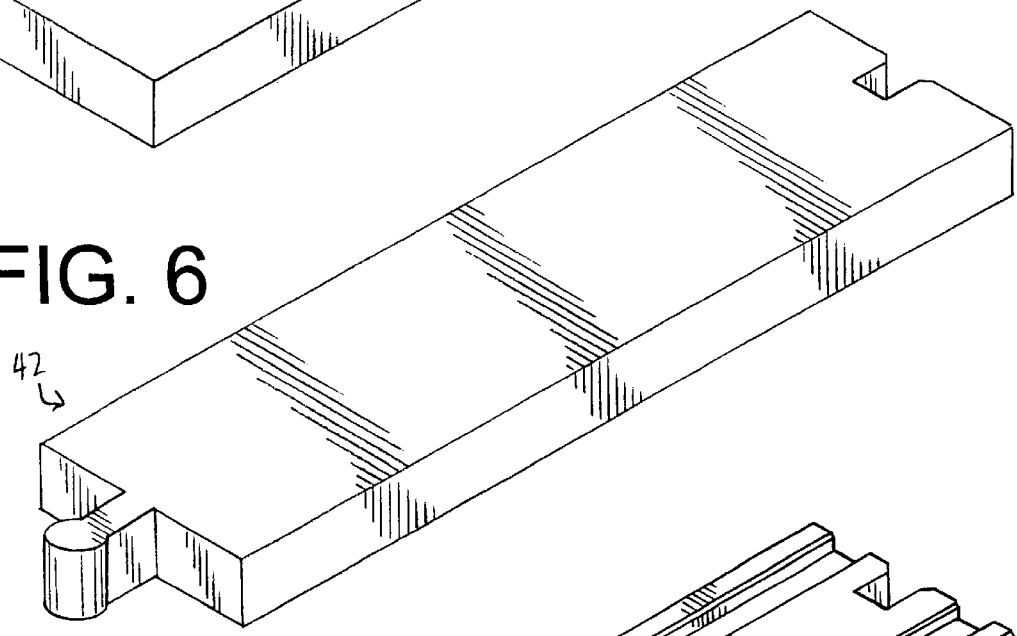
Figure 7:
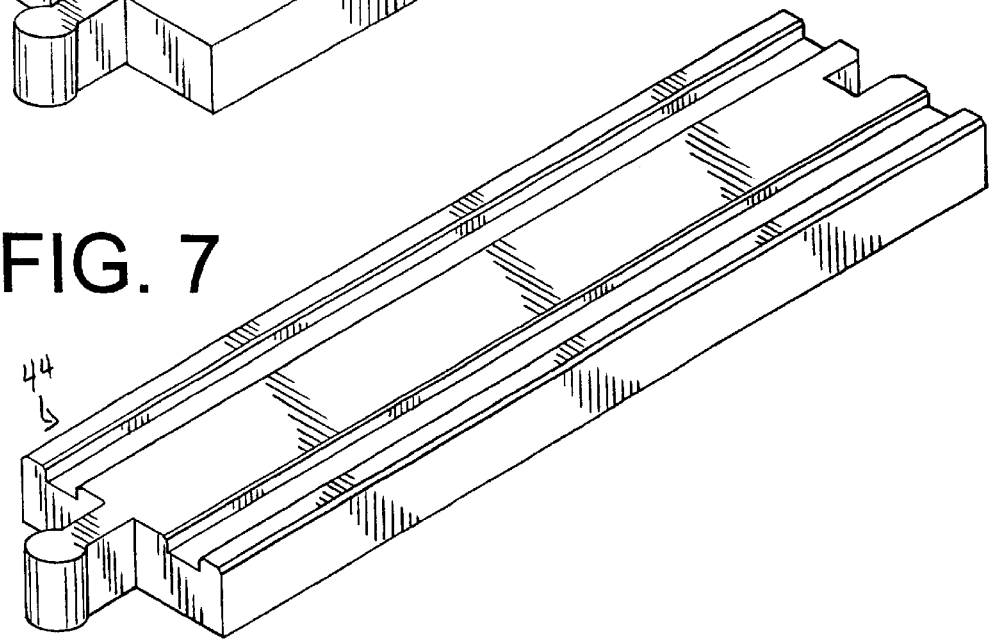
Figure 8:
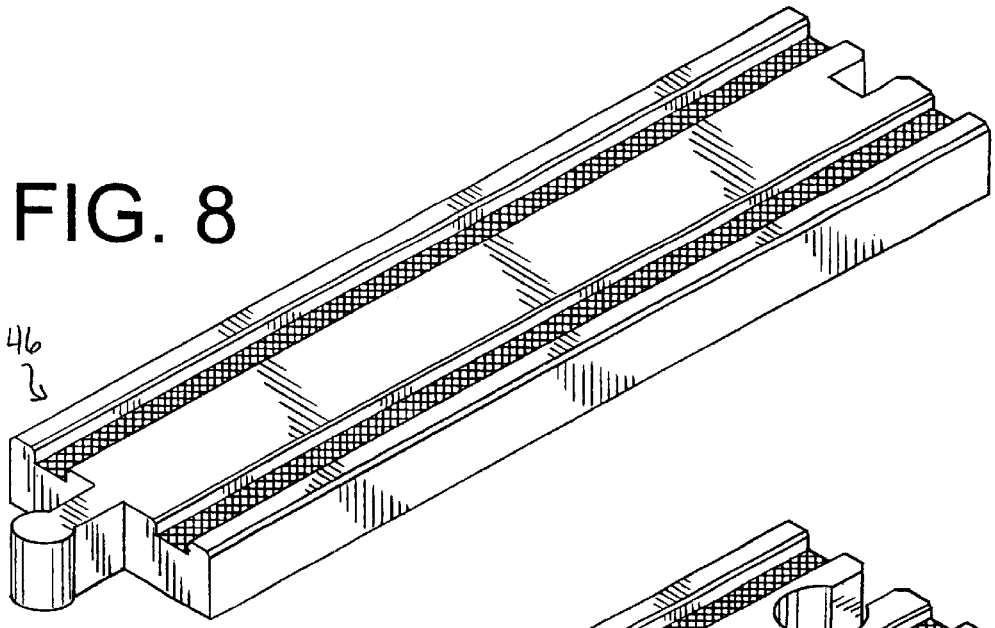
Figure 9:
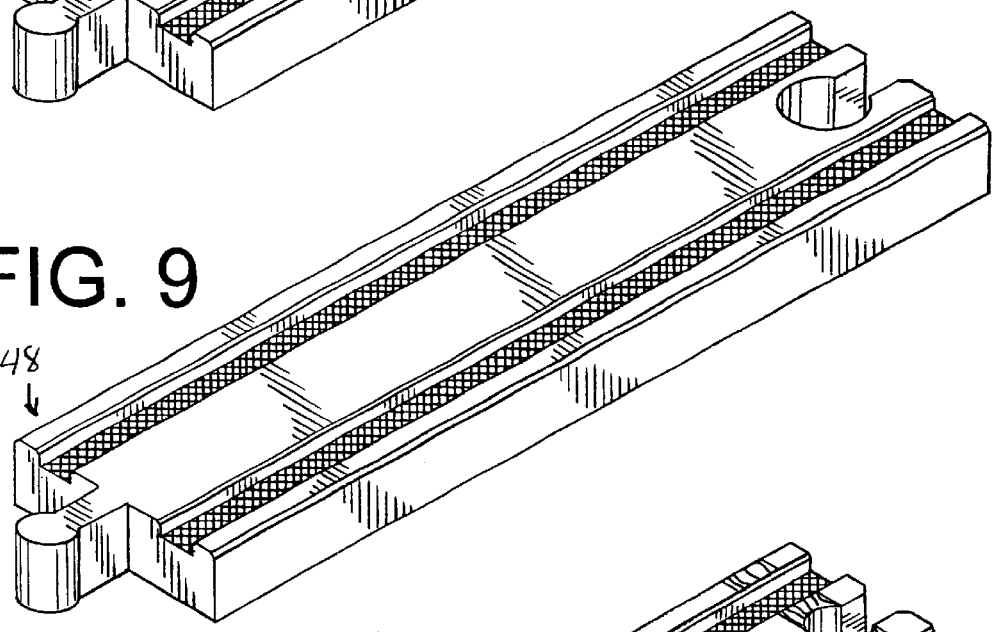
Figure 10:
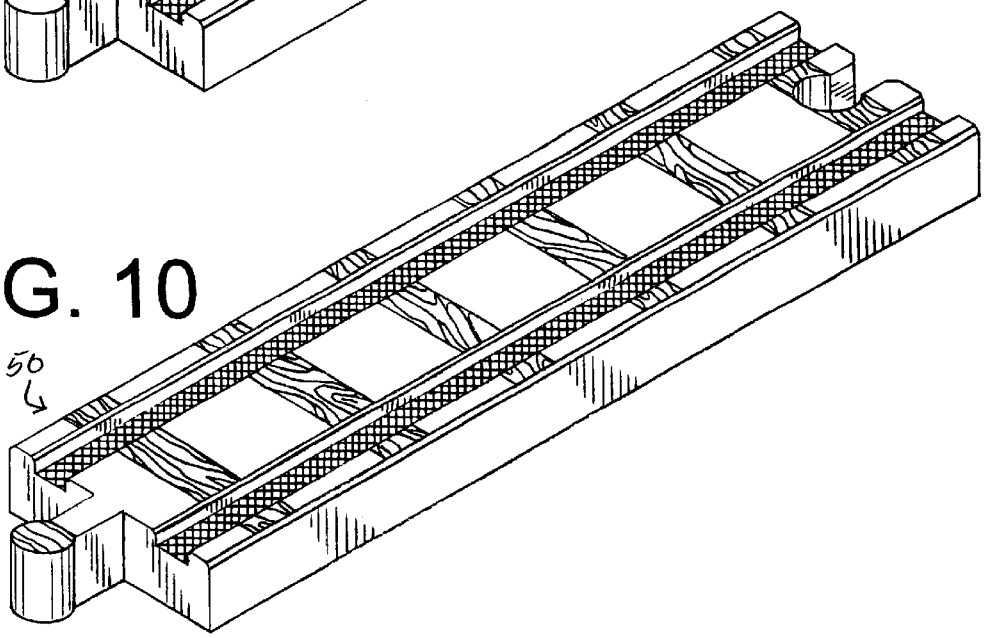
Figure 11A:
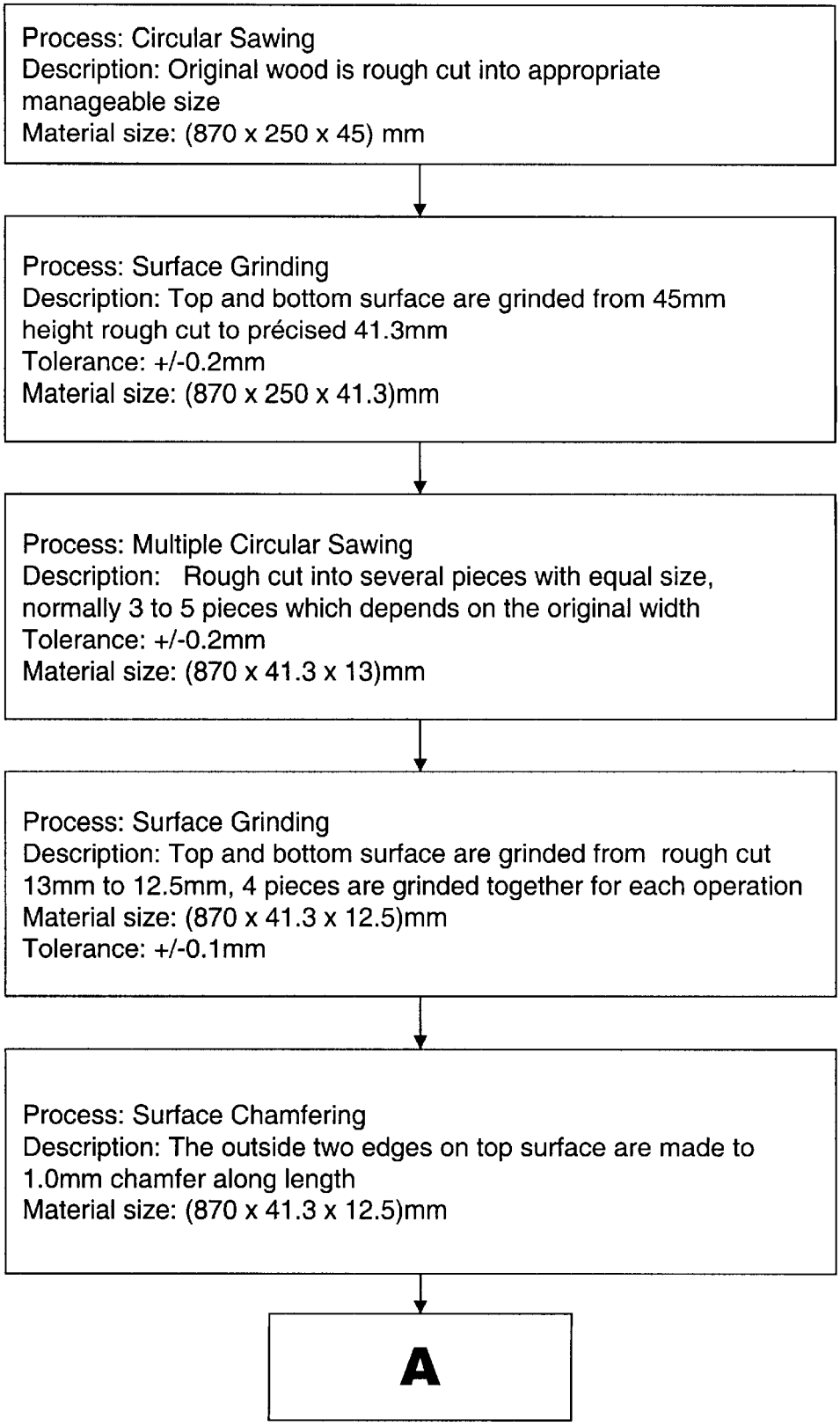
FIGS. 11A, 11B, and 11C show a flowchart of a method of producing a toy vehicle track segment.
Figure 11B:
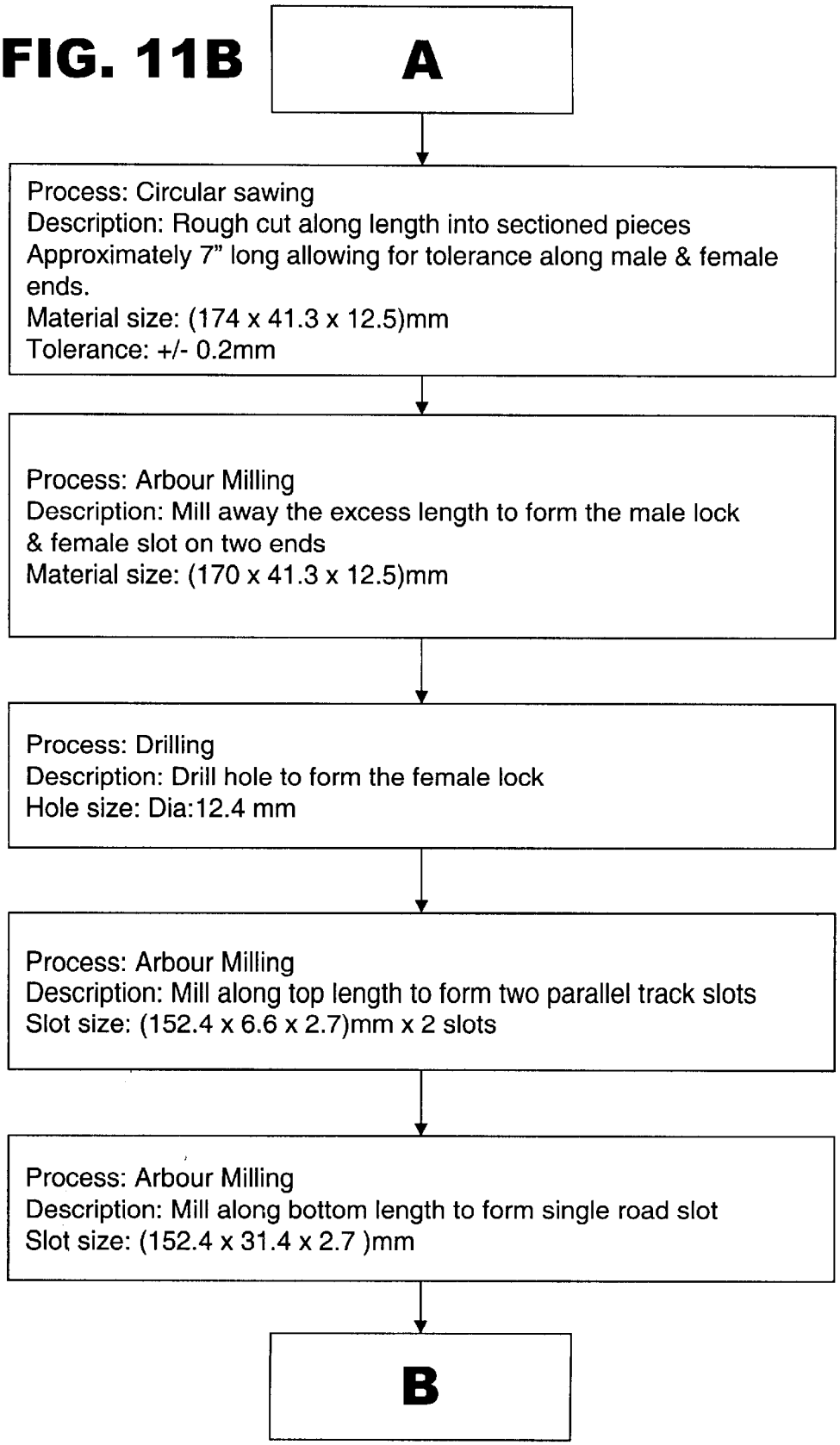
Figure 11C:
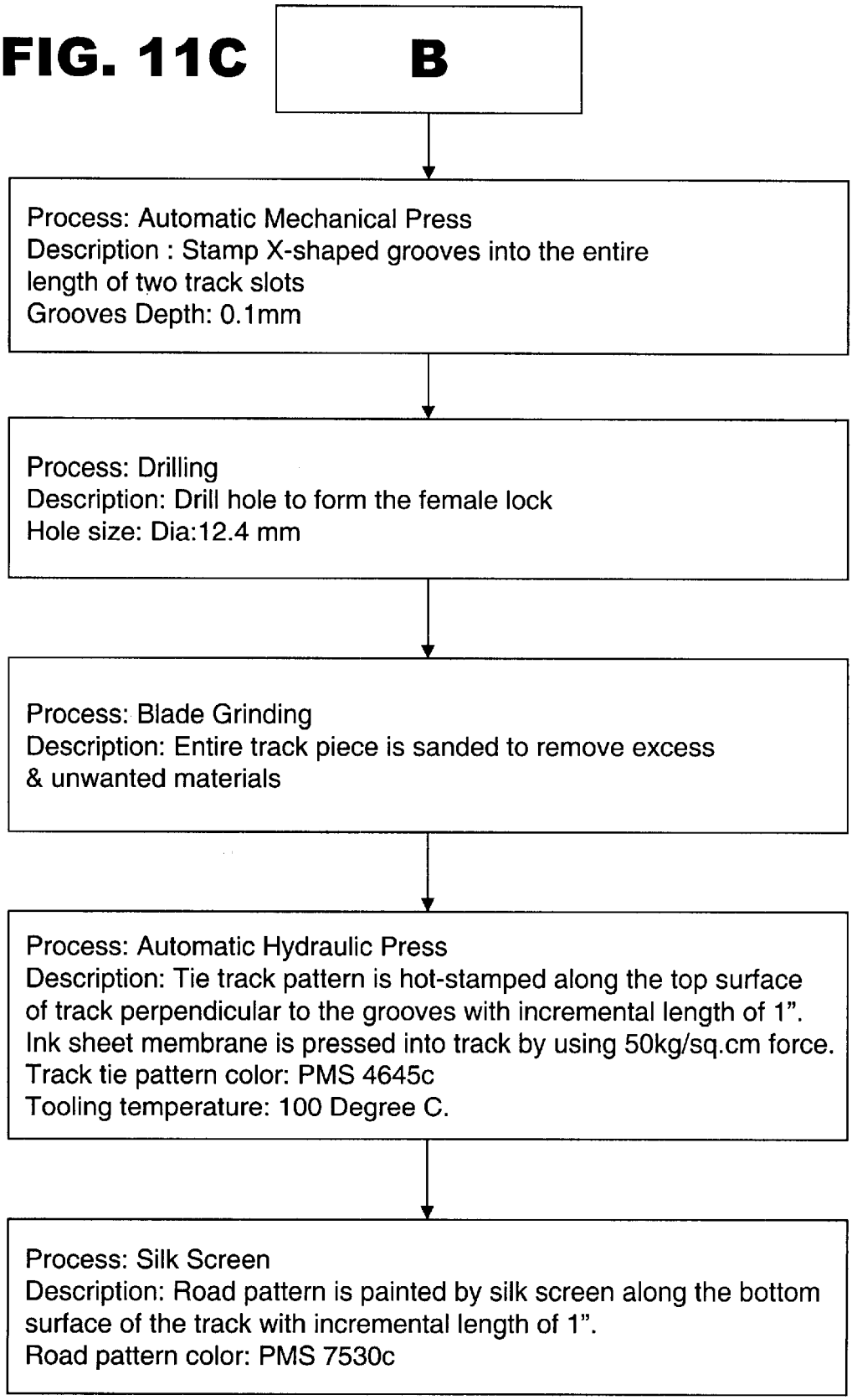

Referring to FIGS. 5–11, the present invention is also directed to methods of manufacturing a toy vehicle track segment 10. One method includes the step of rough cutting pieces to a predetermined length 40. The opposing ends of the rough cut pieces are then arbor milled to form a male connector on one end and a female slot on the opposing end 42. The end with the female slot is drilled to form a female lock which receives a portion of the male connector. (See, e.g., FIG. 9, designated by reference numeral 50)

Next, the upper surface of the piece is arbor milled to from the recessed parallel rails 44. The bottom surface is also arbor milled to form another set of recessed parallel rails or, alternatively, a wider road surface. The base surface of the recessed parallel rails are then mechanically stamped with X-shaped grooves over the entire length of each rail 46, and the entire track piece is sanded to remove excess and unwanted materials.

Next, the railroad tie pattern is added to the track segment 48. In this step, a hydraulic press is used to hot-stamp the tie pattern on the track segment perpendicular to the recessed parallel rails. An ink sheet membrane is utilized to impart the pigment in the impressed tie patterns.

If a road surface is milled onto the bottom surface of the track segment, a silk screening operation is carried out. During the silk screening operation, the road pattern consisting of a dashed line is painted by silk screen along the bottom surface of the track segment. Each dash of the road pattern has an incremental length of approximately one inch.

While specific embodiments have been illustrated and described, numerous modifications are possible without departing from the spirit of the invention, and the scope of protection is only limited by the scope of the accompanying claims.

What is claimed is:

1. A toy vehicle track segment comprising:

a first end;

a second end;

an upper surface having a pair of parallel recessed rails extending over a length of the upper surface from the first end to the second end, each rail having an inner wall joined to an outer wall by a base surface;

a plurality of diamond-shaped nodes located within at least one of the pair of rails for improving traction of a toy vehicle as the toy vehicle traverses along the upper surface, the plurality of diamond-shaped nodes located on the base surface and extending along a first direction transverse to the length of the upper surface.

2. The toy vehicle track segment of claim 1 wherein the plurality of diamond-shaped nodes extend from the inner wall of the rail to the outer wall of the rail.

3. The toy vehicle track segment of claim 1 wherein the plurality of diamond-shaped nodes further extend in a second direction along the length of the upper surface.

4. The toy vehicle track segment of claim 3 wherein plurality of diamond-shaped nodes extend from the inner wall of the rail to the outer wall of the rail.

5. The toy vehicle track segment of claim 4 wherein the plurality of diamond-shaped nodes form a continuous, uninterrupted pattern extending from the first end to the second end.

6. The toy vehicle track segment of claim 1 further comprising a plurality of spaced railroad ties transverse to the pair of parallel rails.

7. The toy vehicle track segment of claim 6 wherein each railroad tie comprises a pair of substantially parallel linear impressions having a plurality of curvilinear impressions therebetween.

8. A toy vehicle track segment comprising:

a distal end;

an opposing proximal end; and an upper surface joining the distal end and the proximal end, the upper surface comprising a pair of parallel recessed rails and a plurality of spaced railroad ties, the rails extending over a length of the upper surface from the distal end to the proximal end, each rail having an inner wall joined to an outer wall by a base surface, and the ties extending transverse to the rails, each tie having a pair of substantially linear parallel debossed impressions with a plurality of curvilinear debossed impressions therebetween.

9. The toy vehicle track segment of claim 8 further comprising a pigmentation within the linear and curvilinear debossed impressions.

10. The toy vehicle track segment of claim 9 further comprising a plurality of nodes located within at least one of the pair of rails for improving traction of a toy vehicle as the toy vehicle traverses along the upper surface.

11. The toy vehicle track segment of claim 10 wherein the plurality of nodes are located on the base surface.

12. The toy vehicle track segment of claim 11 wherein the nodes extend along a first direction transverse to the length of the upper surface.

13. The toy vehicle track segment of claim 12 wherein the plurality of nodes extend from the inner wall of the rail to the outer wall of the rail.

14. The toy vehicle track segment of claim 13 wherein the plurality of nodes further extend in a second direction along the length of the upper surface.

15. The toy vehicle track segment of claim 13 wherein the plurality of nodes form a continuous, uninterrupted pattern extending from the distal end to the proximal end.

16. The toy vehicle track segment of claim 15 wherein at least one of the plurality of nodes has a geometric shape.

17. The toy vehicle track segment of claim 16 wherein the geometric shape is a diamond.

18. A toy vehicle track segment, comprising:

a first end;

a second end;

an upper surface having a pair of parallel recessed rails extending over a length of the upper surface from the first end to the second end and a plurality of ties transverse to the rails, each rail having an inner wall joined to an outer wall by a base surface, and each tie having a pair of substantially linear parallel debossed impressions with a plurality of curvilinear debossed impressions therebetween; and a pigmentation within the linear and curvilinear debossed impressions.

19. A method for producing a toy vehicle track segment comprising the steps of:

providing a segment of a solid material having an upper surface, a lower surface, opposing first and second edges, and opposing first and second ends;

recessing a pair of parallel members into the upper surface extending in a direction from the first end to the second end, each parallel member having a width and a length;

forming a plurality of nodes across the width of at least one of the parallel members; and impressing the upper surface with a railroad tie pattern having a pair of generally spaced edge portions and a plurality of curvilinear patterns therebetween.

* * * * *